United States Patent [19]

Sato

[11] 4,387,984

[45] Jun. 14, 1983

[54] HANDY COPYING SYSTEM

[75] Inventor: Masamichi Sato, Asaka, Japan

[73] Assignee: Fuji Photo Film Co., Ltd., Kanagawa, Japan

[21] Appl. No.: 344,725

[22] Filed: Feb. 1, 1982

[30] Foreign Application Priority Data

| | | | |
|---|---|---|---|
| Feb. 6, 1981 | [JP] | Japan | 56-16703 |
| Feb. 6, 1981 | [JP] | Japan | 56-16704 |
| Feb. 6, 1981 | [JP] | Japan | 56-16705 |
| Feb. 6, 1981 | [JP] | Japan | 56-16707 |

[51] Int. Cl.[3] ..... G03G 15/00

[52] U.S. Cl. ..... 355/12; 355/3 R; 355/3 TR; 355/19; 355/21; 355/16

[58] Field of Search ..... 355/12, 3 R, 3 TE, 3 CH, 355/3 TR, 19, 21, 16

[56] References Cited

U.S. PATENT DOCUMENTS

| | | | |
|---|---|---|---|
| Re. 29,406 | 9/1977 | Walker-Arnott | 355/12 |
| 3,117,501 | 1/1964 | Oliphant | 355/3 CH |
| 3,168,857 | 5/1965 | Hutto | 355/16 X |
| 3,580,672 | 5/1971 | Ando | 355/3 CH |
| 3,752,571 | 8/1973 | Yamaguchi et al. | 355/3 TE |

*Primary Examiner*—A. C. Prescott

*Attorney, Agent, or Firm*—Gerald J. Ferguson, Jr.; Joseph J. Baker; C. Lamont Whitham

[57] ABSTRACT

An electrophotographic copying system includes a contact reflection exposure type electrophotographic photosensitive member received in an open-bottomed portable casing to be moved back and forth with respect to the open bottom of the casing. The copying system is placed on an original to be copied with its open bottom being directed to the original. The photosensitive member is charged while in a position remote from the open bottom and then moved toward the open bottom until it is brought into contact with the original. The photosensitive member is exposed to light from the backside thereof, whereby an electrostatic latent image of the original is formed on the photosensitive member. The photosensitive member is then returned to the position remote from the open bottom of the casing and the latent image is developed to form a toner image of the original. The copying system is subsequently removed from the original and is placed on a transfer medium to which an image of the original is desired to be transferred. The photosensitive member bearing thereon the toner image is again moved toward the open bottom to be brought into contact with the transfer medium, and the toner image is transferred thereto.

18 Claims, 9 Drawing Figures

HANDY COPYING SYSTEM

BACKGROUND OF THE INVENTION

1. Field of the Invention

This invention relates to a portable electrophotographic copying system which can be carried by hand and can reproduce or transfer an image of an original in any position onto a transfer medium without removing the original from its original position.

2. Description of the Prior Art

There have been known various types of copying systems. However, in the conventional copying systems, in order to obtain a copy of an original, the original must be placed in a predetermined position in the copying system. Therefore, a difficulty arises when the original to be copied is not movable. For example, if the original is fixed to a wall or if movement of the original to the copying system is forbidden, it is impossible to obtain a copy thereof using the conventional copying systems.

Further, in the conventional copying systems, the transfer medium to which the image of the original is transferred must be placed in a predetermined position in the copying system. Accordingly, it has been impossible to directly transfer the image of the original to a desired part of a notebook, for example.

SUMMARY OF THE INVENTION

Accordingly, the primary object of the present invention is to provide a portable or handy type copying system which can transfer an image of an original without moving the original from its original position.

Another object of the present invention is to provide a handy type copying system which can directly transfer an image of an original to a desired part of a desired transfer medium without moving either the original or the transfer medium.

It is a further object of the present invention to provide a method of transferring an image of an original to a desired part of a desired transfer medium without moving either the original or the transfer medium.

In accordance with the present invention, there is provided a portable electrophotographic copying system for transferring an image of an original to a transfer medium comprising, a contact reflection exposure type electrophotographic photosensitive member which is enclosed in an outer casing and is movable between an outer position in which it is adapted to be brought into contact with the original and an inner position in which it is inwardly retracted from the outer position, charging means for charging an exposure surface of the electrophotographic photosensitive member, exposing means for projecting light onto the electrophotographic photosensitive member from the side thereof remote from the original when the electrophotographic photosensitive member is in said outer position, thereby forming an electrostatic latent image on said surface of the electrophotographic photosensitive member by exposing the surface to the imagewise light reflected from the original, developing means for developing the electrostatic latent image with toners, and light shielding means for preventing the electrophotographic photosensitive member from being exposed to external light while the photosensitive member is charged and exposed to the light from the exposing means and while the electrostatic latent image is developed, said charging means, exposing means and developing means all being enclosed in said outer housing.

In accordance with one embodiment of the present invention, the toner image of the original formed on the photosensitive member by developing the latent image is transferred to a transfer medium provided independently of the copying system. The transfer can be effected by placing under the independent transfer medium means for establishing an electric or magnetic field for attracting the toners, and by bringing the toner image into contact with the transfer medium.

In accordance with another embodiment of the present invention, the toner image is transferred to a transfer medium contained in the copying system in advance.

DESCRIPTION OF THE PREFERRED EMBODIMENTS

Figure 1:
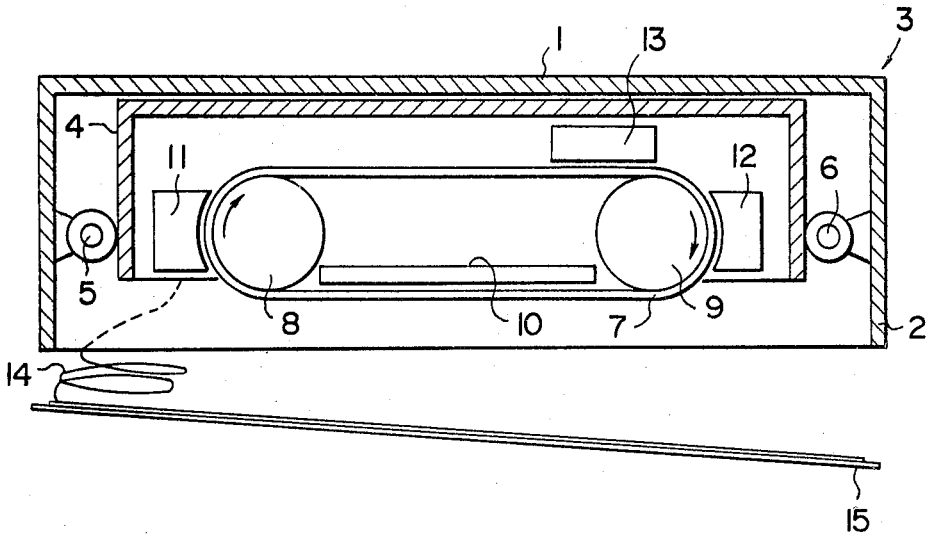
FIG. 1 is a side view partly in cross section of a copying system in accordance with an embodiment of the present invention in its resting condition.
Figure 2:
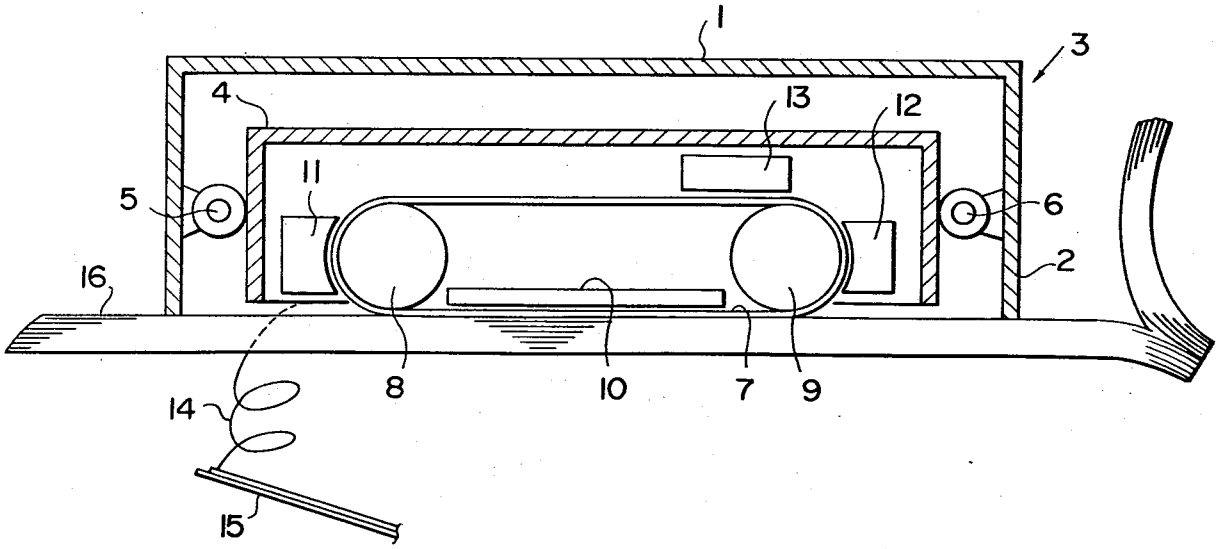
FIG. 2 is a view similar to FIG. 1 but showing the condition of the copying system when forming an electrostatic latent image of an original.
Figure 3:
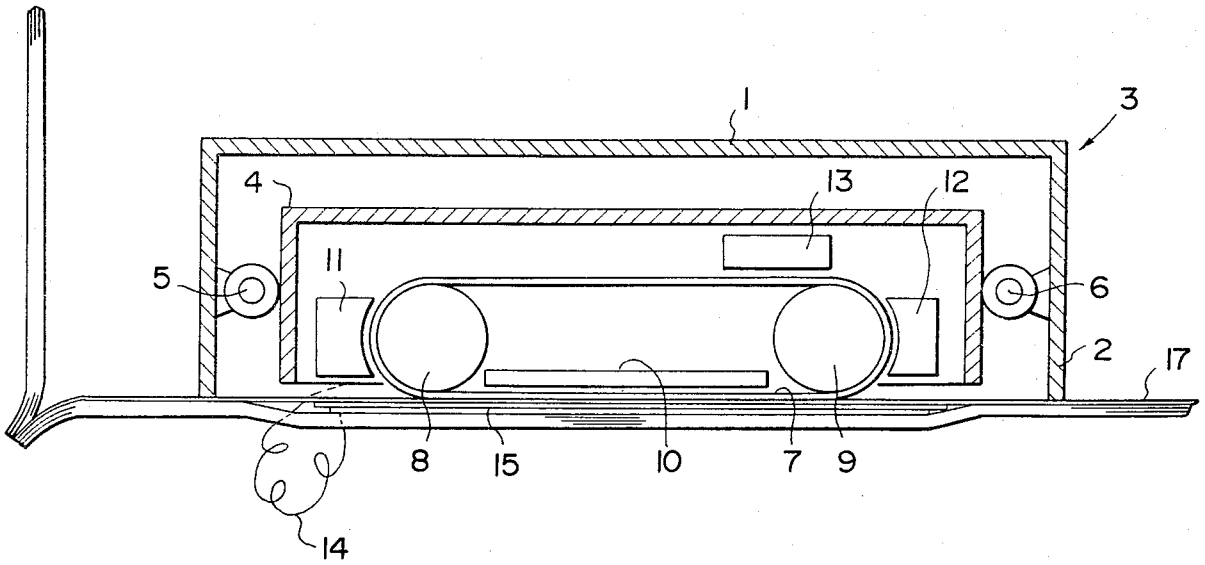
FIG. 3 is a view similar to FIG. 1 but showing the condition of the copying system when transferring a toner image onto a transfer medium.

Now referring to FIGS. 1 to 3, a copying system in accordance with one embodiment of the present invention includes an open-bottomed outer casing 3 having a top wall 1 and four side walls 2. An inner casing 4 which is also open-bottomed is received in the outer casing 3 with its open bottom being directed in the same direction as the outer casing 3. The inner casing 4 is moved up and down by means of a pair of rollers 5 and 6 which abut against side walls of the inner casing 4, as will be described in more detail hereinbelow. In the inner casing 4, are positioned an electrophotographic photosensitive member 7, a light source 10, a developing section 11, a charging section 12 and a cleaning section 13.

The photosensitive member 7 is in the form of an endless belt and is passed around a driving roller 8 and an idling roller 9 with a part thereof facing the open bottom of the inner casing 4. The photosensitive member 7 should be of contact reflection type which can form an electrostatic latent image of an original when it is brought into contact with the original and is exposed to a uniform light from the side thereof remote from the original after the photoconductive layer thereof is charged. For example, an electrophotographic photosensitive member as disclosed in Japanese Unexamined Patent Publication No. 52(1977)-78443 may be used in the present invention. The photosensitive member comprises a transparent base plate having thereon an optical screen formed by a plurality of alternate opaque and transparent portions, and a transparent conductive layer and a transparent photoconductive layer stacked on the base plate in this order.

Said light source 10 is positioned between the driving roller 8 and the idling roller 9 above the lower run of the photosensitive member 7, i.e., said part of the photosensitive member 7 facing the open bottom of the inner casing 4. The light source 10 should be able to provide uniform planar light and may comprise an EL (electroluminescent)-board or may comprise a plurality of miniature lamps and a diffuser panel for diffusing the light emitted from the miniature lamps.

Said developing section 11 is disposed adjacent to the driving roller 8 and may be of well known type such as one utilizing a magnetic brush.

Said charging section 12 is disposed adjacent to the idling roller 9 and may also be of well known type such as one utilizing corona discharge or triboelectrification.

Said cleaning section 13 is disposed above the upper run of the photosensitive member 7 and also may be of well known type such as one utilizing a vacuum suction device and a rotary brush.

The copying system of this embodiment is further provided with a transfer plate 15 which is used to transfer an image of the original to a transfer medium such as paper as will be described in more detail hereinbelow. The transfer plate 15 is connected to a D.C. power source (not shown) in the inner casing 4 by way of an electric cord 14 which is passed through the side wall 2 of the outer casing 3. D.C. voltage is imparted to the transfer plate 15 with the transfer medium placed thereon to extablish an electric field for attracting toners to transfer a toner image on the photosensitive member 7 to the transfer medium. Typically the transfer plate 15 is made of metal. However, it may be made of any material insofar as an electric field for transferring the toner image on the photosensitive member 7 to the transfer medium can be established. Further when magnetic toners are used to develop the electrostatic latent image in the developing section 11, the transfer plate 15 may be one which provides a magnetic field to the toners. Further, the system for transferring the toner image on the photosensitive member 7 to the transfer medium may be provided independently of the body portion of the copying system so long as it can establish the electric field or the magnetic field for attracting the toners to the transfer medium. For example, if an electret plate or a triboelectric plate is used as the transfer plate, the electric cord 14 can be eliminated. Further the transfer plate 15 may be used as a lid for covering the open bottom of the outer casing 3 when the copying system is not used to protect the various components in the outer casing 3.

In the copying system of this embodiment, the part of the photosensitive member 7 facing the open bottom of the inner casing 4 forms the exposure surface on which the electrostatic latent image of the original is formed. The size of the exposure surface is selected to be approximately equal to the size of a post card, for example, through this is not critical.

In use, the copying system is placed on an original 16 (FIG. 2) to be copied with the open bottom of the outer casing 3 directed toward the original 16. Then the main switch (not shown) of the copying system is turned on, whereby an electric motor (not shown) for driving the driving roller 8 is actuated to rotate it in the direction shown by an arrow in FIG. 1. At the same time the cleaning section 13 and the charging section 12 are actuated. The driving roller 8 is rotated until the part of the photosensitive member 7 charged by the charging section 12 is moved to the lower run opposed to the original 16, and then stopped. When the driving roller 8 is stopped, an inner casing driving motor (not shown) is actuated to rotate rollers 5 and 6 to move the inner casing 4 downwardly. When the lower surface of the charged part of the photosensitive member 7 is pressed against the original 16 as shown in FIG. 2 at a predetermined pressure, the inner casing driving motor is stopped. Subsequently, the light source 10 is operated to expose the photosensitive member 7, whereby an electrostatic latent image of the original is formed on the surface of the photosensitive member 7. After exposure for a predetermined time interval, the inner casing driving motor is rotated in the reverse direction to return the inner casing 4 to the position of FIG. 1. When the inner casing 4 is returned to the position of FIG. 1, the electric motor for driving the driving roller 8 is again actuated to rotate the roller 8 in the direction of the arrow, thereby advancing the photosensitive member 7. At this time the developing section 11 is actuated, and the electrostatic latent image on the photosensitive member 7 is developed to form a toner image when the part of the photosensitive member 7 bearing thereon the latent image is passed through the developing section 11. The photosensitive member 7 is stopped after making exactly one revolution, with the cleaning section 13 and the charging section 12 being not actuated during the revolution. Accordingly, the toner image is positioned in the lower run of the photosensitive member 7 facing the open bottom of the outer casing 4 at this time.

The outer casing 3 should be pressed against the original 16 so that the lower edge of the side wall 2 thereof is kept in intimate contact with the upper surface of the original 16 to prevent the photosensitive member 7 from being exposed to external light during the above steps. Therefore, the copying system is conveniently provided with a pilot lamp which is lit when the main switch is turned on and is put out when the photosensitive member 7 is stopped after the development. When the pilot lamp is out, the copying system may be removed from the original 16.

Then the copying system is moved to a transfer medium 17 (FIG. 3) to which the toner image of the original is desired to be transferred and the copying system is placed on the transfer medium 17 with the transfer plate 15 positioned under the transfer medium. Subsequently, a transfer switch (not shown) of the copying system is turned on and the inner casing 4 is moved downward in the manner as described above until the lower surface of the photosensitive member 7 bearing the toner image is pressed against the transfer medium 17 at a predetermined pressure as shown in FIG. 3. When the inner casing 4 is stopped, voltage is applied to the transfer plate to establish an electric field for attracting the toners forming the toner image on the photosensitive member 7, whereby the toner image is transferred to the transfer medium 17. After a predetermined time interval, the application of the D.C. voltage to the transfer plate 15 is terminated and the inner casing 4 is moved upward to the position of FIG. 1. The series of steps described above are carried out in sequence under the control of electric circuitry contained in the copying system.

Figure 4:
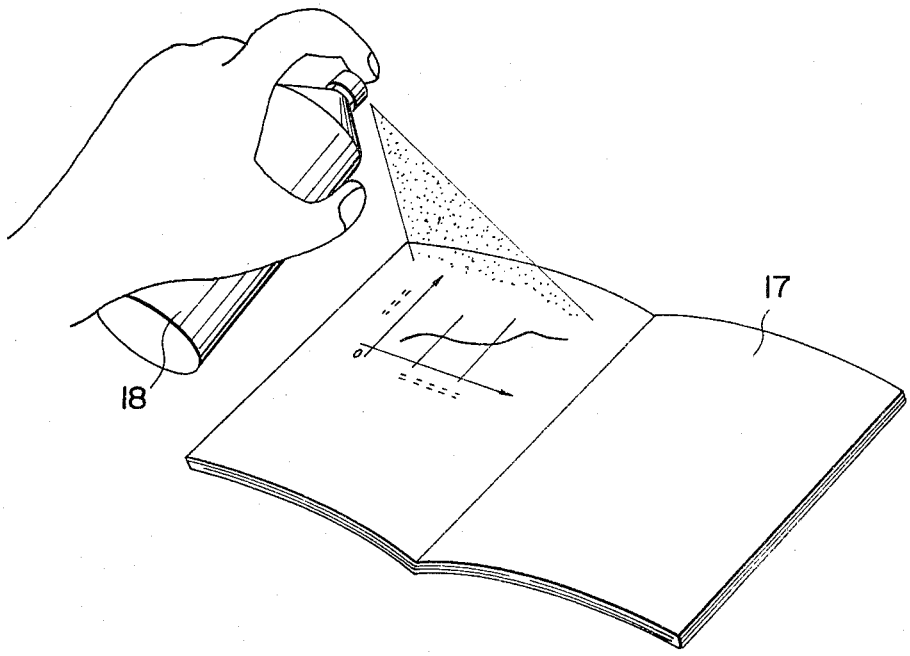
FIG. 4 is a view illustrating a method of fixing the toner image transferred to the transfer medium.

The toner image transferred to the transfer medium 17 is fixed to the transfer medium 17 by means of a fixing agent of transparent plastic material which is sprayed on the transfer medium 17 from a dispenser 18 as shown in FIG. 4.

The copying system of this embodiment can be carried to any place by hand and can transfer an image of an original in any position to a transfer medium in any position. For example, an image of a part of a book can be readily and directly transferred to a given part of a notebook using the copying system of this embodiment. Further the copying system of this embodiment is advantageous in that it is easy to use and is free from the jamming of transfer paper that occurs relatively frequently in conventional copying systems since the transfer medium is not moved within the system in the copying system of this embodiment.

In the above embodiment, the inner casing 4 is moved up and down by means of an electric motor. However the inner casing may be manually moved up and down. In this case, for example, the outer casing is formed of upper and lower halves, one being telescopically received in the other, and the upper half is urged in the direction away from the lower half by a spring means. The inner case is secured to the upper half of the outer casing. Accordingly, the photosensitive member is held in the upper position remote from the open bottom of the outer casing under the force of the spring means. When the photosensitive member is to be brought into contact with the original or the transfer medium, the upper half of the outer casing is manually pushed toward the lower half against the force of the spring means, whereby the photosensitive member is moved toward the open bottom of the outer casing.

Further in the above embodiment, the toner image transferred to the transfer medium 17 is fixed to the transfer medium 17 by applying the fixing agent after removing the copying system from the transfer medium. However, the fixing agent may instead be applied from a spraying means assembled within the copying system, for example.

Further, in the above embodiment, the photosensitive member is in the form of an endless belt. However, the photosensitive member may be in the form of a drum or in the form of a long strip the end portions of which are rolled up and which is moved in the desired direction upon each of the charging, exposing, developing and transferring steps by further rolling up one end portion thereof and rolling out the other end portion thereof.

Now another embodiment of the present invention will be described hereinbelow referring to FIGS. 5 and 6 wherein parts analogous to the parts of FIG. 1 are denoted by the same numerals. In the first embodiment shown in FIGS. 1 to 3, the photosensitive member is in the form of an endless belt and is moved around the rollers. Accordingly the position of the photosensitive member must be accurately controlled. On the contrary, in the embodiment shown in FIGS. 5 and 6, the photosensitive member 21 is in the form of a strip secured to the inner casing 4 at its ends and the photosensitive member 21 is moved only up and down together with the inner casing 4. Thus in this embodiment the difficulty in accurately controlling the position of the photosensitive member is eliminated.

The inner casing 4 is again moved up and down in the outer casing 3 by means of rollers 5 and 6, and the photosensitive member 21 is secured to the inner casing 4 at its ends with its intermediate portion extending across the open bottom thereof. The lower surface of the intermediate portion forms an exposure surface. A uniform light source 10 which may be of the same type as used in the first embodiment is disposed above the photosensitive member 21 within the inner casing 4.

On the longitudinal side walls 2 of the outer casing 3 are formed a pair of guide rails 22. A sliding member 23 is moved back and forth along the guide rails as will be described in more detail hereinbelow. The sliding member 23 has a pair of chambers in which charging means 24 and developing means 25 are housed. The sliding member 23 is connected to and driven by a driving wire 26 which is passed around a driving roller 27, an idling roller 28 and a pair of guide rollers 29.

Figure 5:
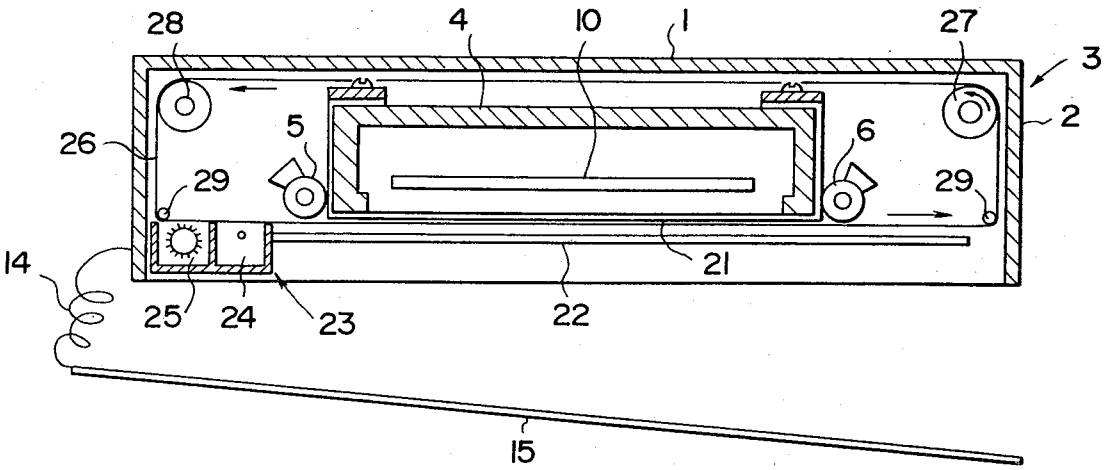
FIG. 5 is a side view partly in cross section of a copying system in accordance with another embodiment of the present invention in its resting condition.
Figure 6:
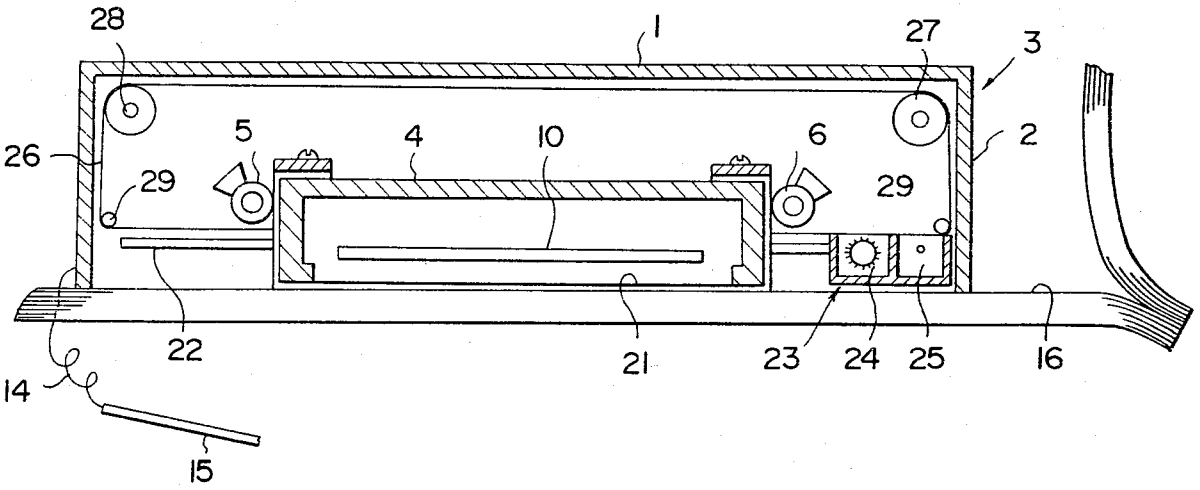
FIG. 6 is a view similar to FIG. 5 but showing the condition of the copying system when forming an electrostatic latent image of an original.

When the body portion of the copying system is placed on an original 16 to be copied and the main switch is turned on, a driving roller motor (not shown) is actuated to rotate the driving roller 27 in the counterclockwise direction to move the sliding member 23 rightwardly from the position shown in FIG. 5 to the position shown in FIG. 6 and at the same time the charging means 24 carried by the sliding member 23 is actuated, whereby the photosensitive member 21 is charged while the charging means travels thereacross. Subsequently, the inner casing 4 is moved downward until the photosensitive member 21 is brought into contact with the original 16 at a predetermined pressure as shown in FIG. 6 in the manner described above with respect to the first embodiment. Then the light source 10 is operated to expose the photosensitive member 21, whereby an electrostatic latent image of the original is formed in the photosensitive member 21. After the latent image is formed, the inner casing 4 is returned to the upper position shown in FIG. 5. Then the sliding member motor is rotated in the reverse direction and at the same time the developing means 25 is actuated. Thus, the electrostatic latent image on the photosensitive member 21 is developed to form a toner image of the original 16 while the developing means 25 travels toward the position shown in FIG. 5 carried by the sliding member 23.

Subsequently, the toner image on the photosensitive member 21 is transferred and fixed to a transfer medium in the same manner as described above with respect to the first embodiment.

A cleaning section may be provided between the charging means 24 and the developing means 25, if desired. In this case the cleaning section is actuated when the sliding member 23 travels rightwardly to clean the exposure surface of the photosensitive member 21 prior to charging thereof.

The charging section 24, the developing section 25 and the cleaning section (if provided) may be separately moved rather than moved together, if desired.

In this embodiment, the photosensitive member 21 is replaced with a new member when the lifetime thereof has expired. However, the photosensitive member may be in the form of a long strip with one end portion thereof rolled up. Then a part of the long photosensitive member may be first used as the exposure surface and when the lifetime of this part has expired, the part is taken up toward the other end portion of the long photosensitive member and a part adjacent to the old part is used as a new exposure surface.

Although, in the above two embodiments, the image of the original is transferred to a transfer medium which is provided independently of the copying system, the image of the original may be transferred to a transfer medium contained in the system in advance.

Figure 7:
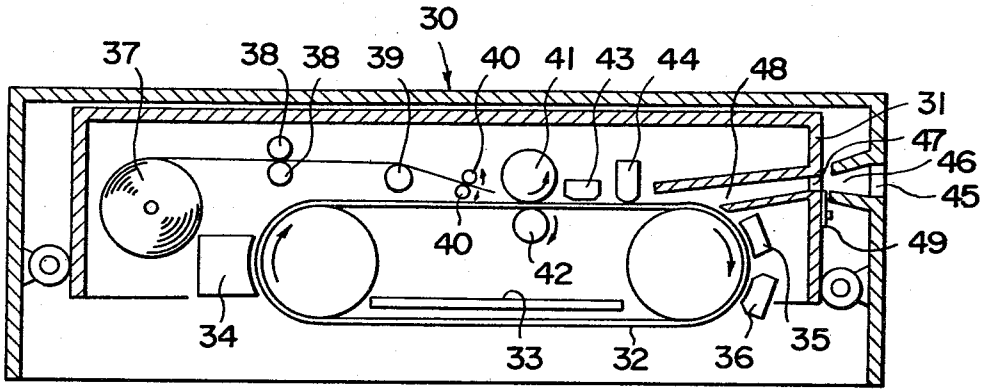
FIG. 7 is a side view partly in cross section of a copying system in accordance with still another embodiment of the present invention in its resting condition.

A copying system in accordance with another embodiment of the present invention shown in FIG. 7 includes an outer casing 30, an inner casing 31, an electrophotographic photosensitive member 32, a light source 33, a developing section 34, a cleaning section 35 and a charging section 36 arranged in a similar manner to those of the embodiment shown in FIGS. 1 to 3. The copying system of this embodiment further comprises a transfer paper feeding assembly disposed near the developing section 34. The transfer paper feeding assembly comprises a roll of long transfer paper 37, a pair of guide rollers 38, a guide roller 39 and a pair of feed rollers 40 pressed against each other. The long transfer paper 37 is passed between the pair of guide rollers 38 and between the pair of feed rollers 40 with its leading end positioned adjacent to the upper run of the photosensitive member 32 and its intermediate portion being supported on the guide roller 39. Adjacent to the leading end of the transfer paper 37 is disposed a pair of guide rollers 41 and 42. The guide rollers 41 and 42 abut against the upper run of the photosensitive member 32 from opposite sides thereof and are rotated by the photosensitive member 32 when the photosensitive member 32 runs. The copying system of this embodiment is further provided with a transferring section 43 and a fixing section 44 disposed adjacent to the guide roller 41 above the upper run of the photosensitive member 32.

Said outer casing 30 is provided with a paper discharge port 45 from which a paper discharge passageway 46 extends inwardly. Further, in one end wall of the inner casing 31 is formed a paper discharge port 47 and a paper discharge passageway 48 extends inwardly from the port 47. The paper discharge port 47 is provided with an openable lid 49. The passageways 46 and 48 are aligned with each other when the inner casing 31 is in the upper position and the lid 49 is automatically opened when a copy of the original is to be discharged as will be described in more detail hereinbelow.

In this embodiment, the electrostatic latent image of the original is formed on the lower surface of the lower run of the photosensitive member 32 in the same manner as in the first embodiment. After the latent image is formed, the inner casing 31 is moved upward to the upper position, and then the photosensitive member 32 is advanced with the developing section 34 being actuated at the same time. The latent image on the photosensitive member 32 is developed to form a toner image when the part of the photosensitive member 32 bearing thereon the latent image is passed through the developing section 34. When the part of the photosensitive member 32 comes below the feed rollers 40, the feed rollers 40 are rotated in the directions shown by arrows to advance the transfer paper 37 toward the guide roller 41 which is rotated by the photosensitive member 32. The transfer paper 37 is brought into contact with the part of the photosensitive member 32 bearing thereon the toner image guided by the guide roller 41 and runs together with the part. The toner image on the part of the photosensitive member 32 is transferred and fixed to the transfer paper 37 when the paper 37 and the part of the photosensitive member 32 are passed through the transferring section 43 and the fixing section 44. The transfer paper 37 is severed by means of a cutter (not shown) disposed between the feed rollers 40 and the guide roller 41 when the transfer paper is fed by a length equal to the length of the exposure surface. Thus a copy of the original is obtained and the copy is discharged through the passageway 48, the discharge post 47, the passageway 46 and the discharge post 45 which are aligned with each other at this time since the inner casing 31 is in the upper position. Further, the lid 49 is arranged to be automatically opened when the trailing end of the exposure surface passes by the developing section 34, and therefore has been opened by this time. The photosensitive member 32 is further advanced after the copy is discharged, and is stopped after the completion of cleaning of the exposure surface.

In order to ensure that the exposure surface of the photosensitive member is accurately located with respect to the original or the transfer medium, it is preferred that the inside of the inner casing be observable with the copying system kept in contact with the original or the transfer medium.

Figure 8:
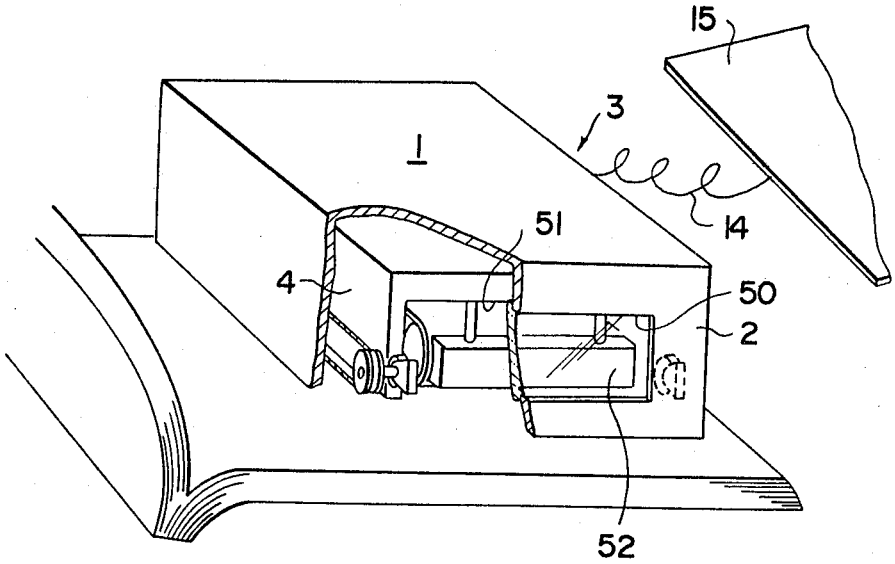
FIG. 8 is a partly broken away perspective view of a modification of the copying system of FIG. 1.

In a modification of the first embodiment shown in FIG. 8, an opening 50 is formed in one side wall 2 of the outer casing 3 and a wide opening 51 is formed in the side wall of the inner casing 4 opposed to the side wall 2 of the outer casing 3. The opening 50 in the outer casing 3 is covered with an optical filter 52. The spectral characteristics of the optical filter 52 are selected with respect to the characteristics of the photosensitive member used in the particular copying system so that the optical filter 52 transmits only light which is within the visible region but is insensible for the photosensitive member, whereby the inside of the inner casing 4 can be observed from the outside without influencing the charging step or the latent image forming step.

For example, when the photoconductive layer of the photosensitive member is of phthalocyan, the optical filter may be one which transmits only light having a wavelength near 500 nm. Similarly, when the photoconductive layer of the photosensitive member is of selenium, the optical filter may be one which transmits only red light which is insensible for the photoconductive material of selenium. Further, the insensible region of an electrophotographic photosensitive member having a photoconductive layer of zinc oxide can be freely varied by dye sensitization. Of course, the outer casing 3 and the inner casing 3 may be entirely made of such an optical filter.

Figure 9:
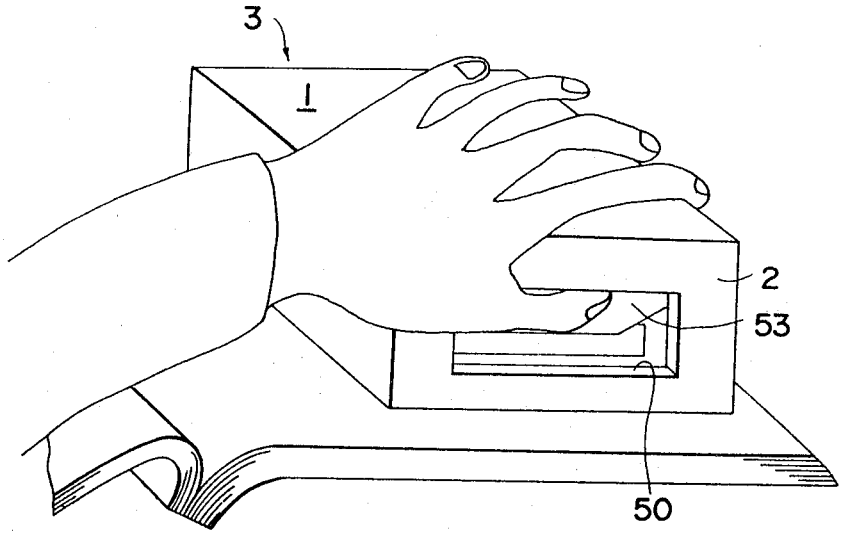
FIG. 9 is a perspective view of another modification of the copying system of FIG. 1.

The opening 50 in the side wall 2 of the outer casing 3 may be provided with an openable lid 53 formed of light shielding material as shown in FIG. 9 instead of the optical filter. In this case, the lid 53 is opened when locating the exposure surface with respect to the original or the transfer medium, and is closed when the exposure surface is located accuratly with respect to the original or the transfer medium.

What is claimed is:

1. A portable electrophotographic copying system for transferring an image of an original to a transfer medium comprising, a contact reflection exposure type electrophotographic photosensitive member which is enclosed in an outer casing and is movable between an outer position in which it is adapted to be brought into contact with the original and an inner position in which it is inwardly retracted from the outer position, charging means for charging an exposure surface of the electrophotographic photosensitive member, exposing means for projecting light onto the electrophotographic photosensitive member from the side thereof remote from the original when the electrophotographic photosensitive member is in said outer position, thereby forming an electrostatic latent image on said exposure surface of the electrophotographic photosensitive member by exposing the surface to the imagewise light reflected from the original, developing means for developing the electrostatic latent image with toners to form a toner image, and light shielding means for preventing the electrophotographic photosensitive member from being exposed to external light while the photosensitive member is charged and exposed to the light from the exposing means and while the electrostatic latent image is developed, said charging means, exposing means and developing means all being enclosed in said outer housing.

2. A copying system as defined in claim 1 wherein said outer casing is in the form of a box having a closed top wall, closed side walls and an open bottom, and said photosensitive member is movable between said outer position adjacent to the open bottom and said inner position remote therefrom.

3. A copying system as defined in claim 2 wherein the lower ends of said closed side walls of the outer casing are kept in contact with the original while said photosensitive member is charged and exposed to the light from the exposing means and while the electrostatic latent image is developed, whereby said closed side walls form said light shielding means.

4. A copying system as defined in claim 3 wherein said photosensitive member, charging means, exposing means and developing means are mounted in an inner casing having an open bottom which is movably received in said outer casing with said open bottom directed toward the open bottom of the outer casing, the inner casing being adapted to be moved between a first position in which said open bottom of the inner casing is positioned near the open bottom of the outer casing and a second position in which the open bottom of the inner casing is remote from the open bottom of the outer casing, and said exposure surface of the photosensitive member being slightly projected from the open bottom of the inner case.

5. A copying system as defined in claim 4 wherein said photosensitive member is in the form of an endless belt passed around a pair of rollers to make an outer run and an inner run, and said exposure surface is in the inner run.

6. A copying system as defined in claim 5 wherein said photosensitive member is adapted to be moved around said pair of rollers and said charging means and developing means are located near the path of the photosensitive member.

7. A copying system as defined in claim 6 wherein said exposing means is located between said outer run and inner run.

8. A copying system as defined in claim 4 wherein said photosensitive means is in the form of a strip secured to the inner casing at its ends with its intermediate portion extending across the open bottom of the inner casing, said exposure surface being in the outer surface of the intermediate portion thereof.

9. A copying system as defined in claim 8 wherein said charging means and developing means are moved back and forth across the exposure surface to charge and develop the electrostatic latent image on the exposure surface.

10. A copying system as defined in claim 1 further comprising a transfer means to be interposed between the transfer means and the exposure surface bearing thereon the toner image for establishing an electric field for attracting toners forming said toner image.

11. A copying system as defined in claim 10 wherein said transfer means is a metal plate which is adapted to be applied with a D.C. voltage from a D.C. voltage source.

12. A copying system as defined in claim 11 wherein said D.C. voltage source is located within said outer casing.

13. A copying system as defined in claim 10 wherein said transfer means is an electret plate.

14. A copying system as defined in claim 10 wherein said transfer means is a triboelectric plate.

15. A copying system as defined in claim 1 wherein said outer casing is provided with a window for viewing the inside thereof without adversely influencing said charging means, exposing means and developing means.

16. A copying system as defined in claim 15 wherein said window comprises an opening formed in the outer casing and provided with an optical filter the spectral characteristics of which are selected with respect to the characteristics of the photosensitive member to transmit only light which is within the visible region but is insensible for the photosensitive member.

17. A copying system as defined in claim 15 wherein said window comprises an opening formed in the outer casing and provided with an openable lid made of light shielding material for closing the opening.

18. A copying method comprising, a step of placing on an original to be copied, a copying system comprising a contact reflection exposure type photoelectrographic photosensitive member, an exposing means and a developing means all contained in a casing with said photosensitive member being opposed to the original, a step of shielding the photosensitive member and the original from external light, a step of charging the photosensitive member, with the device being held in said position and with the photosensitive member separated from the original, a step of bringing the charged photosensitive member into contact with the original and exposing the photosensitive member to light from the side thereof remote from the original to form an electrostatic latent image of the original on the surface of the photosensitive member, a step of separating the photosensitive member from the original and developing the electrostatic latent image to form a toner image on the photosensitive member, a step of transferring the toner image to a transfer medium by bringing the copying system into contact with the transfer medium, and a step of fixing the transferred toner image to the transfer medium by application of a fixing agent.

* * * * *